US009336971B2

(12) United States Patent
Morimoto et al.

(10) Patent No.: US 9,336,971 B2
(45) Date of Patent: May 10, 2016

(54) SWITCH

(71) Applicant: OMRON Corporation, Kyoto-shi, Kyoto (JP)

(72) Inventors: Masaru Morimoto, Shiga (JP); Tomoyuki Washizu, Shiga (JP); Takekazu Komori, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/384,315

(22) PCT Filed: Mar. 11, 2013

(86) PCT No.: PCT/JP2013/056668

§ 371 (c)(1),
(2) Date: Sep. 10, 2014

(87) PCT Pub. No.: WO2013/137202

PCT Pub. Date: Sep. 19, 2013

(65) Prior Publication Data

US 2015/0060247 A1 Mar. 5, 2015

(30) Foreign Application Priority Data

Mar. 15, 2012 (JP) ..... 2012-059367

(51) Int. Cl.
*H01H 21/36* (2006.01)
*H01H 1/18* (2006.01)
(Continued)

(52) U.S. Cl.
CPC ..... *H01H 21/36* (2013.01); *H01H 1/18* (2013.01); *H01H 3/38* (2013.01); *H01H 21/12* (2013.01);
(Continued)

(58) Field of Classification Search
CPC ..... H01H 1/18; H01H 1/20; H01H 1/26; H01H 2221/088; H01H 3/42; H01H 21/12; H01H 2221/036; H01H 3/40; H01H 1/40; H01H 1/44; H01H 21/24; H01H 2203/036; H01H 1/36; H01H 3/04; H01H 9/02; H01H 21/28; H01H 19/14; H01H 1/242; H01H 3/38; H01H 21/14; H01H 21/36; H01H 2205/002; H01H 3/50; H01H 21/50; H01H 2229/014; H01H 2205/02; H01H 2221/044; H01H 21/30
USPC ..... 200/252, 16 R–16 D, 520, 530–536, 553, 200/557–559, 561–563, 276.1, 61.82, 8 R, 200/17 R, 260, 11 R, 335
See application file for complete search history.

(56) References Cited

U.S. PATENT DOCUMENTS 6,768,069 B1 * 7/2004 Su ..... H01H 1/242 200/276.1
6,917,008 B1 * 7/2005 Ni ..... H01H 21/282 200/16 C (Continued)

FOREIGN PATENT DOCUMENTS

EP 1903590 A1 3/2008
JP 64-10921 U 1/1989

(Continued)

OTHER PUBLICATIONS

International Search Report issued in PCT/JP2013/056668 mailed on May 7, 2013 (4 pages)

(Continued)

*Primary Examiner* — Edwin A. Leon
(74) *Attorney, Agent, or Firm* — Osha Liang LLP

(57) ABSTRACT

A switch has an actuating arm including an actuating portion and a driving portion, a base including a support that supports the actuating arm, and a recess having a first fixed electrode and a second fixed electrode arranged on the inner side face, and an electrically conductive elastic member that is housed within the recess of the base. The electrically conductive elastic member includes at least one driven part that is driven by the driving portion of the driving body and at least one stretching part that is extendable and compressible through input to the at least one driven part, at least one movable contacting member having a movable contact capable of being connected to the first fixed electrode, and at least one fixed contacting part having a fixed contact capable of being connected to the second fixed electrode.

14 Claims, 12 Drawing Sheets

(51) Int. Cl.

| | |
|---|---|
| ***H01H 3/38*** | (2006.01) |
| ***H01H 21/12*** | (2006.01) |
| *H01H 1/20* | (2006.01) |
| *H01H 1/26* | (2006.01) |
| *H01H 3/40* | (2006.01) |
| *H01H 3/42* | (2006.01) |

(52) U.S. Cl.
CPC .. *H01H 1/20* (2013.01); *H01H 1/26* (2013.01); *H01H 3/40* (2013.01); *H01H 3/42* (2013.01); *H01H 2221/036* (2013.01); *H01H 2221/088* (2013.01)

(56) References Cited

U.S. PATENT DOCUMENTS

| | | | | |
|---|---|---|---|---|
| 7,223,931 | B2 * | 5/2007 | Kiyono ..... | H01H 1/36 200/276.1 |
| 2003/0094360 | A1 | 5/2003 | Nishimura et al. | |

FOREIGN PATENT DOCUMENTS

| | | | |
|---|---|---|---|
| JP | 2003-132765 | A | 5/2003 |
| JP | 2004-362979 | A | 12/2004 |
| JP | 2005-332644 | A | 12/2005 |
| JP | 3870748 | B2 | 1/2007 |
| JP | 2010-129336 | A | 6/2010 |
| JP | 2010-250944 | A | 11/2010 |
| TW | 2008-28375 | A | 7/2008 |
| TW | M388082 | U1 | 9/2010 |

OTHER PUBLICATIONS

Office Action issued in Taiwanese Application No. 102109301, mailed on Nov. 7, 2014 (16 pages)

Office Action issued in corresponding Korean Application No. 10-2014-7023929, mailed on Nov. 19, 2015 (11 pages).

* cited by examiner

SWITCH

BACKGROUND

1. Technical Field

The present invention relates to a switch and, in particular, to an ultrasmall switch for use in electronic devices such as mobile phones, smartphones, and digital cameras that are thin and low in parts count.

2. Related Art

Patent Document 1 discloses a switch device including a housing having a shaft protruding from the bottom face of an annular recess on which fixed contacts are arranged, an annular rotating handle that is housed in the recess of the housing and has an actuating arm, a nearly annular return spring fitted onto the shaft of the recess of the housing, and a movable contact spring having movable contacts arranged in the space between the shaft of the housing and the inner circumferential face of the rotating handle.

According to the switch disclosed in Patent Document 1, the volume ratios of the rotating handle and a coil spring used as the return spring over the entire switch are large, and it is difficult to downsize the switch.

In particular, the movable contact spring is arranged between the recess of the housing and the return spring, and the contact structure constituted by the movable contacts of the movable contact spring and the fixed contacts of the recess increases the thickness of the switch, which makes it difficult to slim down switch-mounted products.

It also requires the housing, the rotating handle, the return spring, and the movable contact spring to constitute the switch, in other words, the parts count is high.

CITATION LIST

Patent Document

Patent Document 1: Japanese Patent Application Laid-open Publication No. 2004-362979

SUMMARY

One or more embodiments of the present invention achieves slimming down and a reduction in parts count.

A switch according to one or more embodiments of the present invention includes an actuating arm including an actuating portion and a driving portion; a base including a support that supports the actuating arm, and a recess having a first fixed electrode and a second fixed electrode arranged on the inner side face; and an electrically conductive elastic member that is housed within the recess of the base, the electrically conductive elastic member including at least one driven part that is driven by the driving portion of the driving body and at least one stretching part that is extendable and compressible through input to the at least one driven part, at least one movable contacting member having a movable contact capable of being connected to the first fixed electrode, and at least one fixed contacting part having a fixed contact capable of being connected to the second fixed electrode. The switch has a first position in which the movable contact is disconnected from the first fixed electrode, and a second position in which the at least one stretching part of the electrically conductive elastic member is in a compressed state and the movable contact is in contact with the first fixed electrode. The actuating arm is capable of being moved from the first position to the second position when a load is applied to the actuating arm at the first position. The actuating arm is automatically returned from the second position to the first position when the load on the actuating arm is removed at the second position.

The switch includes an actuating arm including an actuating portion and a driving portion; a base including a support that supports the actuating arm, and a recess having a first fixed electrode and a second fixed electrode arranged on the inner side face; and an electrically conductive elastic member that is housed within the recess of the base, the electrically conductive elastic member including at least one driven part that is driven by the driving portion of the driving body and at least one stretching part that is extendable and compressible through input to the at least one driven part, at least one movable contacting member having a movable contact capable of being connected to the first fixed electrode, and at least one fixed contacting part having a fixed contact capable of being connected to the second fixed electrode. The switch has a first position in which the movable contact is in contact with the first fixed electrode and a second position in which the at least one stretching part of the electrically conductive elastic member is in a compressed state, and the movable contact is disconnected from the first fixed electrode. The actuating arm is capable of being moved from the first position to the second position when a load is applied to the actuating arm at the first position. The actuating arm is automatically returned from the second position to the first position when the load on the actuating arm is removed at the second position.

One or more embodiments of the present invention arranges a contact structure and a spring structure on the same plane and houses the electrically conductive elastic member in the recess of the base, thereby achieving the slimming down of the switch. This reduces switch mounting space and facilitates the slimming down of electronic devices.

The at least one fixed contacting part and the at least one movable contacting member are integrally formed to constitute the electrically conductive elastic member, thereby reducing a parts count. This reduces manufacturing costs and assembly man-hours.

In one or more embodiments of the present invention, the electrically conductive elastic member is manufactured by electroforming and that the at least one fixed contacting part, the at least one stretching part, the at least one driven part, and the at least one movable contacting member are arranged on the same plane.

One or more embodiments of the present invention manufactures the electrically conductive elastic member by electroforming and arranges the at least one fixed contacting part, the at least one stretching part, the at least one driven part, and the at least one movable contacting member on the same plane, thereby achieving a thin switch. Although the expression "arranges on the same plane" means that the thicknesses of the at least one fixed contacting part, the at least one stretching part, the at least one driven part, and the at least one movable contacting member when they are arranged on the same plane are the same, at least partial thickness may be different, and it is only required that the directions of the extension and compression or operation of the parts are on the same plane.

In one or more embodiments of the present invention, the upper faces of the actuating arm and the electrically conductive elastic member are flush with the upper face of the base.

One or more embodiments of the present invention constitutes a switch with a size depending on the thickness of the base.

One or more embodiments of the present invention includes a third position, on the opposite side of the second position with respect to the first position, that is a compressed state from which the at least one stretching part of the electrically conductive elastic member automatically returns the actuating arm to the first position and in which the movable contact is in contact with the first fixed electrode.

One or more embodiments of the present invention can arrange the first position at a midpoint within a rotation range and has the effect of reducing a maximum stroke from the first position and constituting an automatic return switch to which three kinds of modes can be assigned.

One or more embodiments of the present invention includes a third position, on the opposite side of the second position with respect to the first position, that is a compressed state from which the at least one stretching part of the electrically conductive elastic member automatically returns the actuating arm to the first position and in which the movable contact is separate from the first fixed electrode.

One or more embodiments of the present invention can arrange the first position at a midpoint within the rotation range and has the effect of reducing the maximum stroke from the first position and constituting an automatic return switch to which three kinds of modes can be assigned.

According to one or more embodiments of the present invention, the electrically conductive elastic member is integrally formed.

One or more embodiments of the present invention has the effect of reducing a parts count and assembly man-hours.

One or more embodiments of the present invention, the driving portion of the actuating arm and the at least one driven part of the electrically conductive elastic member are gear mechanisms.

One or more embodiments of the present invention has the effect of surely transmitting the driving force of the driving portion of the actuating arm to the at least one driven part of the electrically conductive elastic member.

DETAILED DESCRIPTION

Embodiments of the present invention will be described with reference to the attached drawings of FIG. 1A to FIG. 12. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

First Embodiment

As illustrated in FIG. 1A to FIG. 4, the switch according to the first embodiment includes a base 10, an actuating arm 30, an electrically conductive elastic member 40, and a cover 50. The terms "up," "down," "left," and "right" below are conveniently used for description with reference to the drawings and do not intend to limit installation arrangement.

Figure 1A:
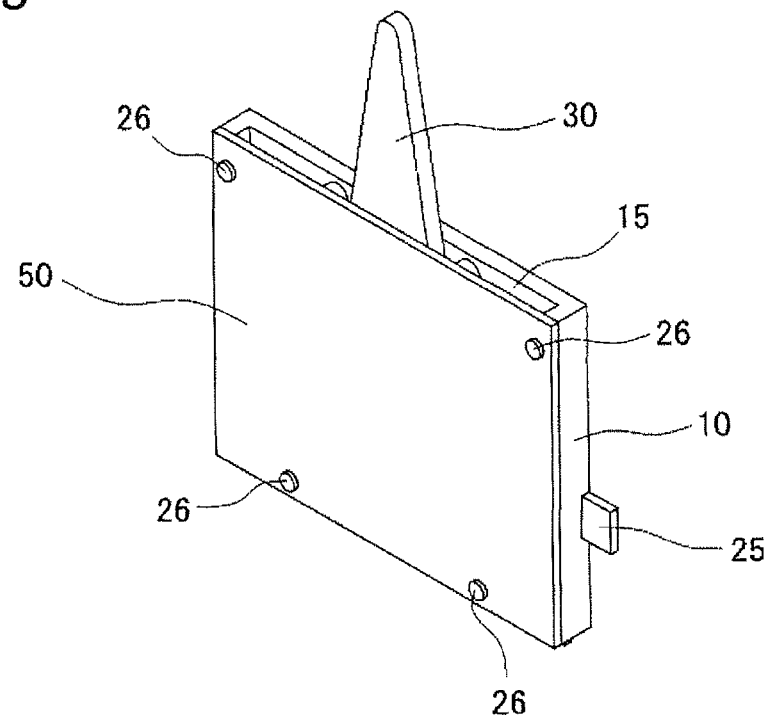
FIGS. 1A and 1B are perspective view and a side view, respectively, of a switch of a first embodiment of the present invention.
Figure 1B:
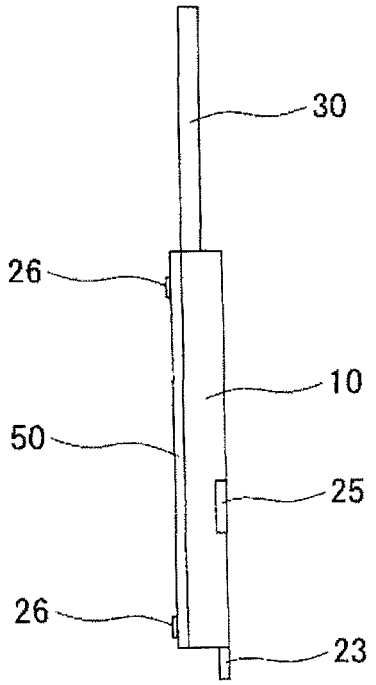
Figure 2:
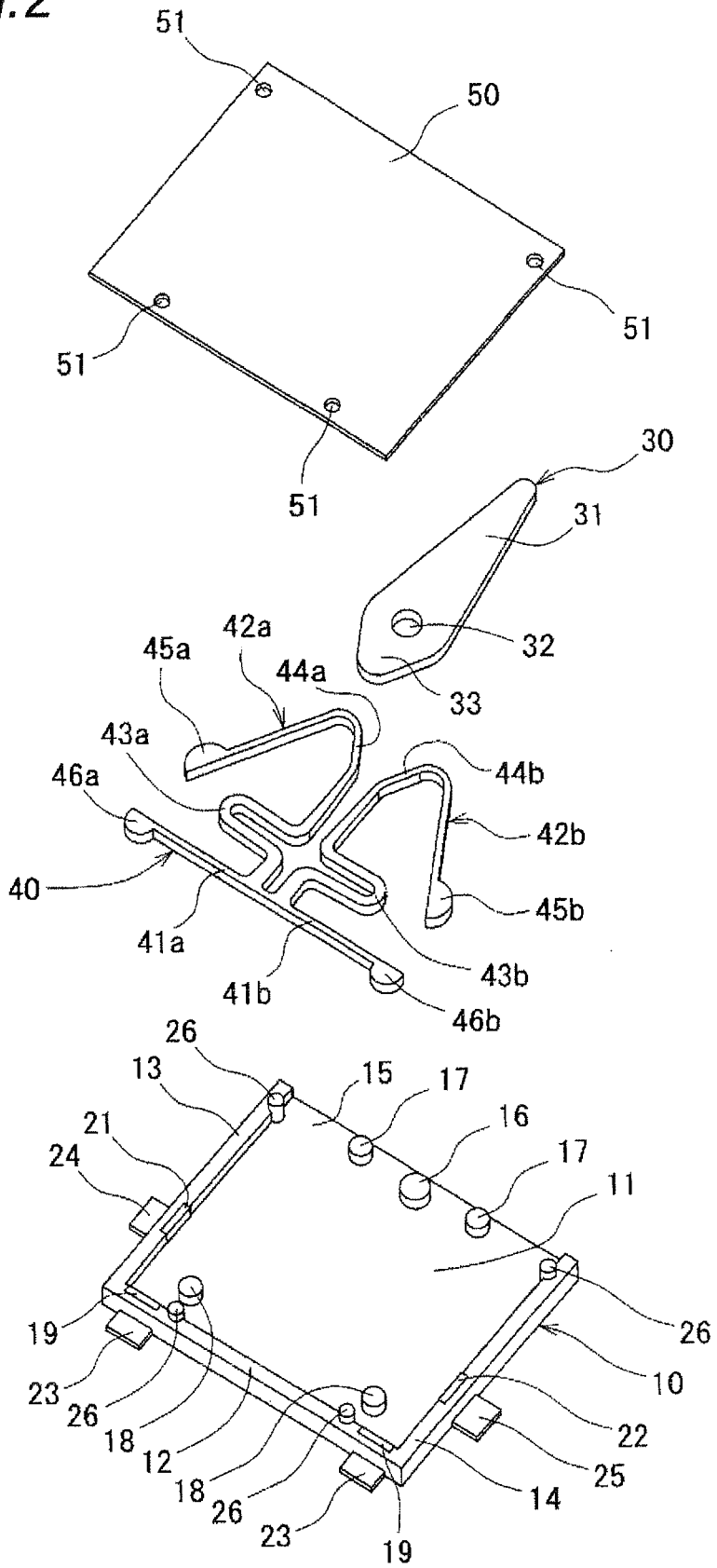
FIG. 2 is an exploded perspective view of the switch of a first embodiment of the present invention.
Figure 3:
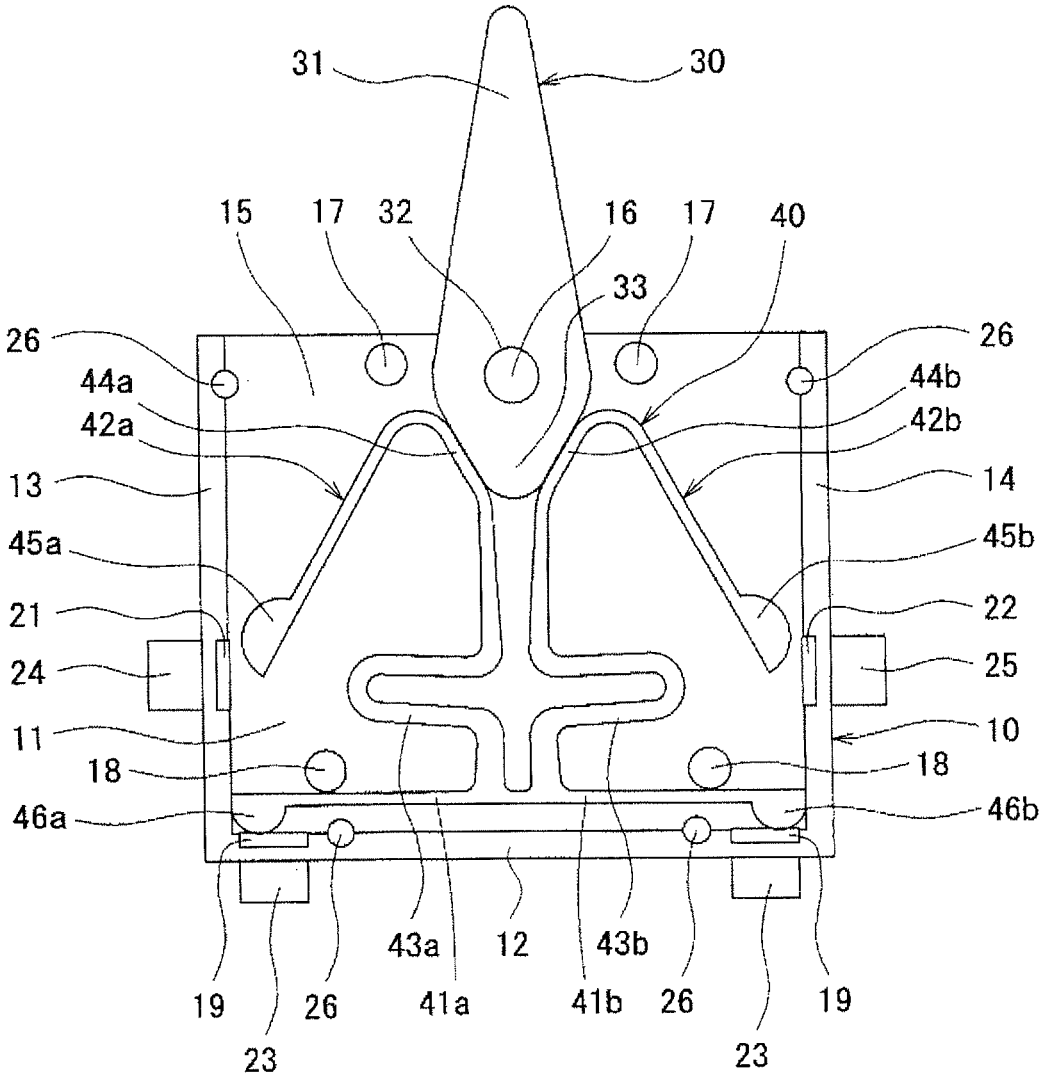
FIG. 3 is a plan view illustrating a state with a cover of the switch of the first embodiment removed.

As illustrated in FIG. 3, the base 10 forms a U-shaped periphery on the upper face thereof and forms a housing recess (hereinafter, referred to as a recess) 11 that houses the electrically conductive elastic member 40 described below thereinside. The periphery includes a lower periphery 12, a left periphery 13, and a right periphery 14, and an opening 15 is positioned on the upper side.

A shaft (support) 16 that fits into a hole 32 of the actuating arm 30 described below is arranged at the center of the opening 15, and restricting parts 17, 17 are arranged on both sides of the shaft 16 that restrict the rotation range of the actuating arm 30 about the shaft 16. Positioning parts 18 are arranged in the recess 11 that position each fixed contacting parts 41*a*, 41*b* of the electrically conductive elastic member 40 described below.

Lower fixed or stationary contacts (second fixed or stationary electrodes) 19, 19 are arranged on both ends of the inner side face of the lower periphery 12. These two lower fixed contacts 19, 19 are arranged to ensure contact even with failed contact at either one of the contacts.

A left fixed or stationary contact (first fixed or stationary electrode) 21 is arranged on the inner side face of the left periphery 13, whereas a right fixed or stationary contact (first fixed or stationary electrode) 22 is arranged on the inner side face of the right periphery 14. The left fixed contact 21 and the right fixed contact 22 are arranged within the movable ranges of contacts 45*a*, 45*b* of movable contacting members 42*a*, 42*b* of the electrically conductive elastic member 40 described below, allowing connection and disconnection between the fixed contacts 21, 22 and the movable contacting members 42*a*, 42*b*.

The fixed contacts 19, 21, 22 include connecting parts 23, 24, 25, respectively, that protrude from the outer side faces of the peripheries 12 to 14.

Crimping protrusions 26 are arranged on the peripheries 12 to 14 of the base 10 that fit into crimping holes 51 of the cover 50 described below.

The actuating arm 30 includes an actuating portion 31 arranged on one side of the hole (inserted hole) 32 that fits onto the shaft 16 of the base 10 and a driving portion 33 arranged on the other side thereof. The actuating portion 31 and the driving portion 33 are both shaped in a nearly isosceles triangle. The hole 32 is aligned with the longitudinal center line of the actuating arm 30. The tip of the driving portion 33 is rounded.

The driving portion 33 presses a left driven part 44*a* of the electrically conductive elastic member 40 described below when the actuating arm 30 is rotated clockwise from a first position by means of the actuating portion 31 and presses a right driven part 44*b* of the electrically conductive elastic member 40 described below when the actuating arm 30 is rotated counterclockwise from the first position.

The electrically conductive elastic member 40 is manufactured by electroforming, including the fixed contacting parts 41*a*, 41*b* that are formed along a straight line and the movable contacting members 42*a*, 42*b*, which are formed symmetrically.

Contacts (fixed contacts) 46*a*, 46*b* are formed at the tips of the fixed contacting parts 41*a*, 41*b*, respectively, which are arranged so as to come into contact with the lower fixed contacts 19.

The movable contacting members 42*a*, 42*b* include stretching parts 43*a*, 43*b* and driven parts 44*a*, 44*b*, which extend from the fixed contacting parts 41*a*, 41*b*, respectively. The stretching parts 43*a*, 43*b* are shaped nearly in a U-shaped, from the tips of which the driven parts 44*a*, 44*b* extend upward, respectively. The movable contacting members 42*a*, 42*b* are curved so as to extend toward the fixed contacts 21, 22 arranged on the left and right peripheries 13, 14, beyond the driven parts 44*a*, 44*b*, respectively. The contacts (movable contacts) 45*a*, 45*b* are formed at the tips of the movable contacting members 42*a*, 42*b*, respectively.

The cover 50 has a planar shape that can cover the base 10 and includes the crimping holes 51 at positions corresponding to the crimping protrusions 26 of the base 10.

The fixed contacting parts 41*a*, 41*b* of the electrically conductive elastic member 40 are arranged and positioned between the lower periphery 12 and the positioning parts 18, 18 of the base 10, thereby housing the electrically conductive elastic member 40 in the recess 11 of the base 10. In addition, the hole 32 of the actuating arm 30 is fitted onto the shaft 16 of the base 10, thereby arranging the actuating portion 31 of the actuating arm 30 at the center of the opening 15 of the base 10 and housing the actuating arm 30 in the recess 11. In this state, the driven parts 44*a*, 44*b* are arranged in a position such that they can be pressed by the driving portion 33 of the actuating arm 30. The driven parts 44*a*, 44*b* are in close contact with the driving portion 33 at the first position (neutral position) described below, preventing a shaky relationship between the driving portion 33 of the actuating arm 30 and the movable contacting members 42*a*, 42*b*. After that, the crimping holes 51 of the cover 50 are fitted onto the crimping protrusions 26 of the base 10, and then the crimping protrusions 26 are fused to integrate them.

Next, the operation of the switch having the above structure will be described. For example, the switch according to the first embodiment may be used for a zoom mechanism of a DVD camera.

At the first position (neutral position) illustrated in FIG. 3, the driving portion 33 of the actuating arm 30 is in close contact with the driven parts 44*a*, 44*b* of the movable contacting members 42*a*, 42*b* so as to prevent loose contact with the movable contacting members 42*a*, 42*b*. At the first position, the contacts 45*a*, 45*b* are not in contact with any of the fixed contacts 21, 22, and hence the switch serves no electrical connection therebetween.

Figure 4:
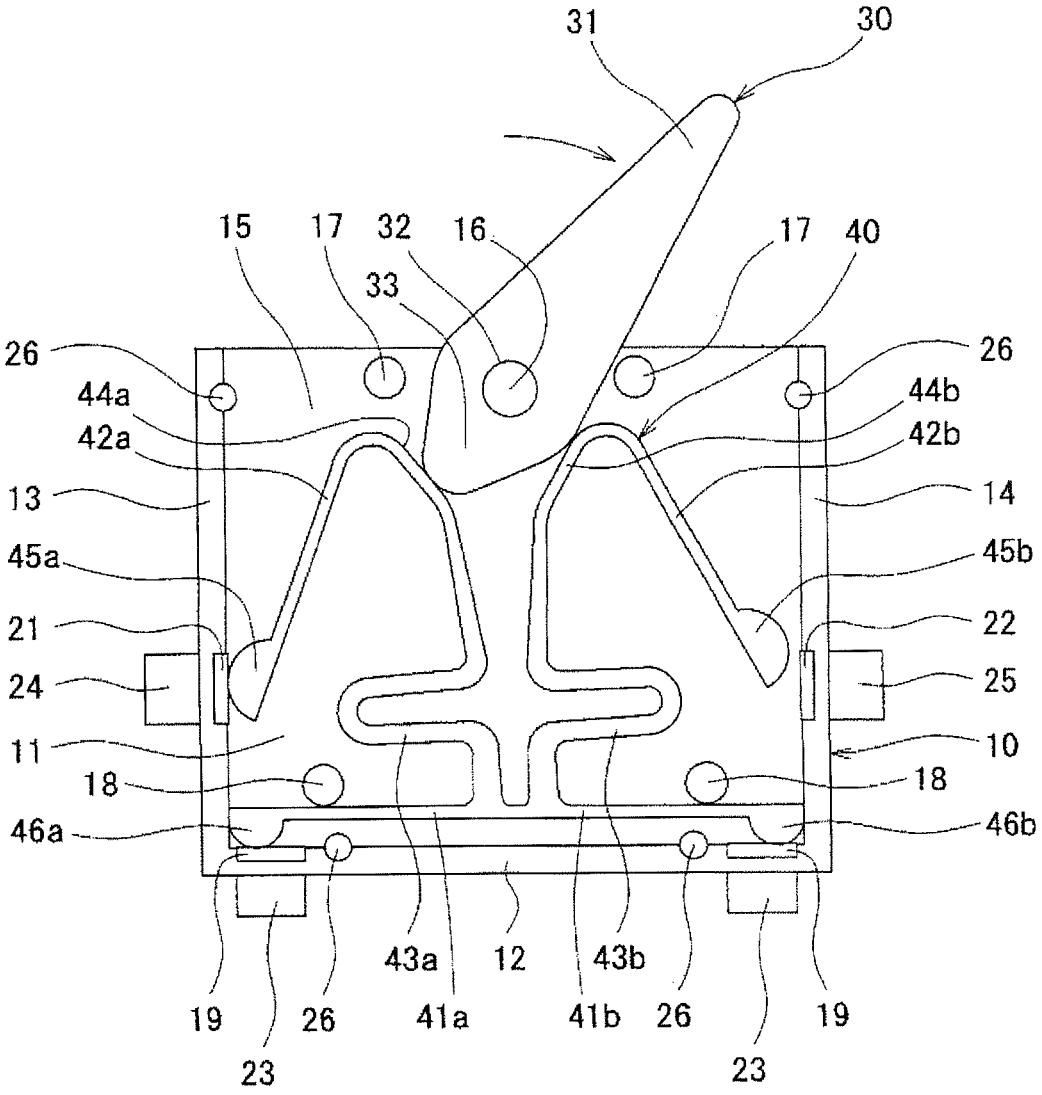
FIG. 4 is a diagram illustrating a switched position of the switch of the first embodiment.

When the actuating arm 30 is rotated clockwise from the first position by means of the actuating portion 31, as illustrated in FIG. 4, the driving portion 33 of the actuating arm 30 presses the driven part 44*a* of the movable contacting member 42*a*, and the actuating arm 30 reaches a second position. At the second position, the movable contacting member 42*a* is biased toward the first position. At the second position, the contact 45*a* is in contact with the left fixed contact 21 for electrical connection between the left fixed contact 21 and the lower fixed contacts 19, 19.

When the load on the actuating arm 30 positioned at the second position is removed, the movable contacting member 42*a* elastically returns mainly through the spring force of the stretching part 43*a* to the first position. This disconnects the contact 45*a* from the left fixed contact 21, causing disconnection between the left fixed contact 21 and the lower fixed contacts 19, 19.

When the actuating arm 30 is rotated counterclockwise from the first position, the actuating arm 30 performs operation opposite to the above. In other words, the position at which the contact 45*b* is in contact with the right fixed contact 22 is a third position. At the third position, the right fixed contact 22 and the lower fixed contacts 19, 19 are electrically connected each other.

When the load on the actuating arm 30 positioned at the third position is removed, an operation will be performed similar to that when the load on the actuating arm 30 positioned at the second position is removed.

According to one or more embodiments of the present invention, the electrically conductive elastic member 40 is integrally formed to include the fixed contacting parts 41*a*, 41*b* and the movable contacting members 42*a*, 42*b* so that a parts count and assembly man-hours are reduced, thereby reducing manufacturing costs.

Also, the contact structure and the spring structure are arranged in a planar configuration, and the thin electrically conductive elastic member 40 is housed in the plate-shaped housing recess 11, thereby achieving the slimming down of the switch. In particular, manufacturing the electrically conductive elastic member 40 by means of electroforming allows achieving a thin switch. This can reduce switch mounting space and facilitate the slimming down of electronic devices.

The first embodiment may have the advantage that a switch which automatically returns to the first position is achieved, when removing the load applied to the actuating portion 31 of the actuating arm 30 at the second position arranged on one side of the first position and the third position arranged on the other side thereof.

Figure 5:
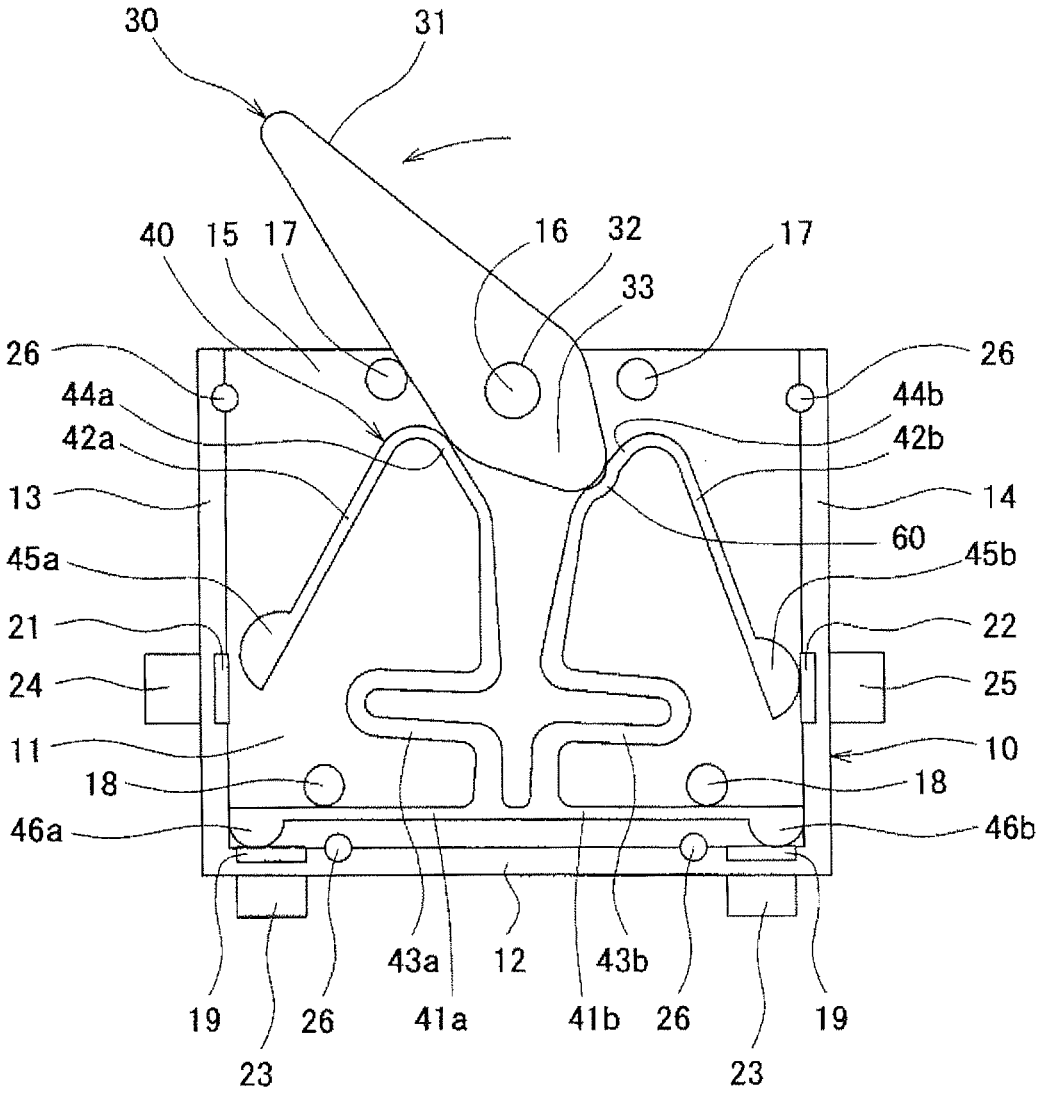
FIG. 5 is a diagram illustrating a modification of the switch of the first embodiment.

Alternatively, as illustrated in FIG. 5, the switch of the first embodiment may be structured to include an engagement recess 60 on the driven part 44*b* of the movable contacting member 42*b* of the electrically conductive elastic member 40, allowing the driving portion 33 of the actuating arm 30 to be held in the engagement recess 60 of the electrically conductive elastic member 40 even after the load applied to the actuating portion 31 is released, while the actuating arm 30 at the second position automatically returns to the first position when the load applied to the actuating portion 31 is released.

In this switch, when the actuating arm 30 is rotated counterclockwise from the first position, the driving portion 33 of the actuating arm 30 presses the driven part 44*b* of the movable contacting member 42*b*, thereby bringing the contact 45*b* of the movable contacting member 42*b* into contact with the right fixed contact 22 at the third position. At the third position, the right fixed contact 22 and the lower fixed contacts 19, 19 are electrically connected each other.

When the load on the actuating arm 30 is removed at the third position, the actuating arm 30 is pressed back to the first position through the elastic return force of the movable contacting member 42*b*.

When the actuating arm 30 is further rotated counterclockwise from the third position, the driving portion 33 of the actuating arm 30 engages with the engagement recess 60 of the driven part 44*b* of the electrically conductive elastic member 40, and the actuating arm 30 reaches a fourth position. At the fourth position, the movable contacting member 42*b* is biased toward the first position. Also at the fourth position, the contact 45*b* is in contact with the right fixed contact 22, and the right fixed contact 22 and the lower fixed contacts 19, 19 are short-circuited.

When the actuating arm 30 is rotated clockwise from the fourth position by means of the actuating portion 31, the driven part 44*b* of the electrically conductive elastic member 40 elastically deforms, the driving portion 33 of the actuating arm 30 overcomes an end of the engagement recess 60 of the driven part 44*b*, and the movable contacting member 42*b* elastically returns mainly through the spring force of the stretching part 43*b* to return to the first position. This disconnects the contact 45*a* from the right fixed contact 22, causing disconnection between the right fixed contact 22 and the lower fixed contacts 19, 19.

According to the first embodiment, when rotated from the fourth position, the driving portion 33 of the actuating arm 30 overcomes the end of the engagement recess 60 of the driven part 44*b*, which securely returns the actuating arm 30 to the first position through the elastic return force of the electrically conductive elastic member 40.

Second Embodiment

Figure 6:
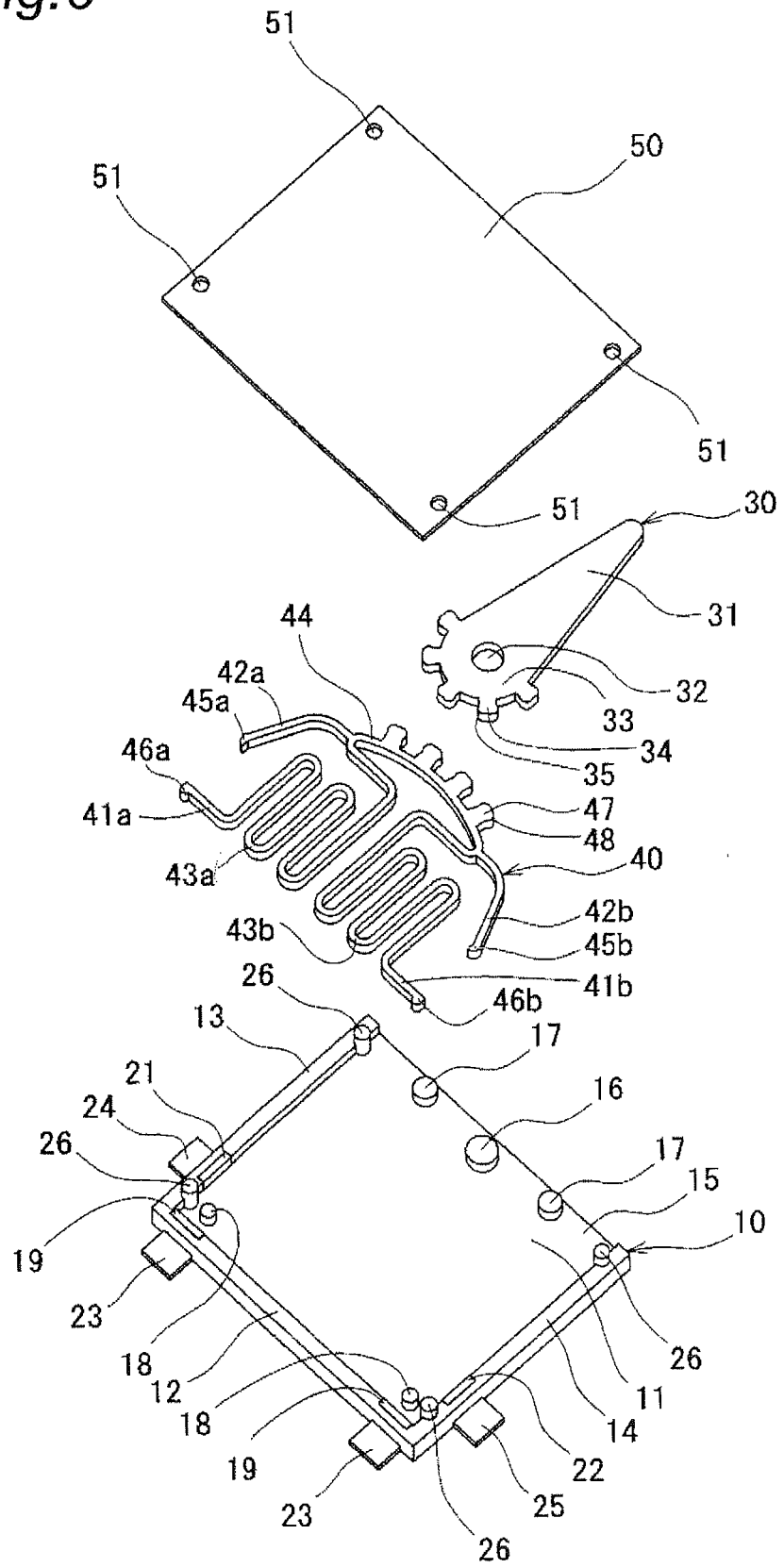
FIG. 6 is an exploded perspective view of a switch of a second embodiment of the present invention.
Figure 7:
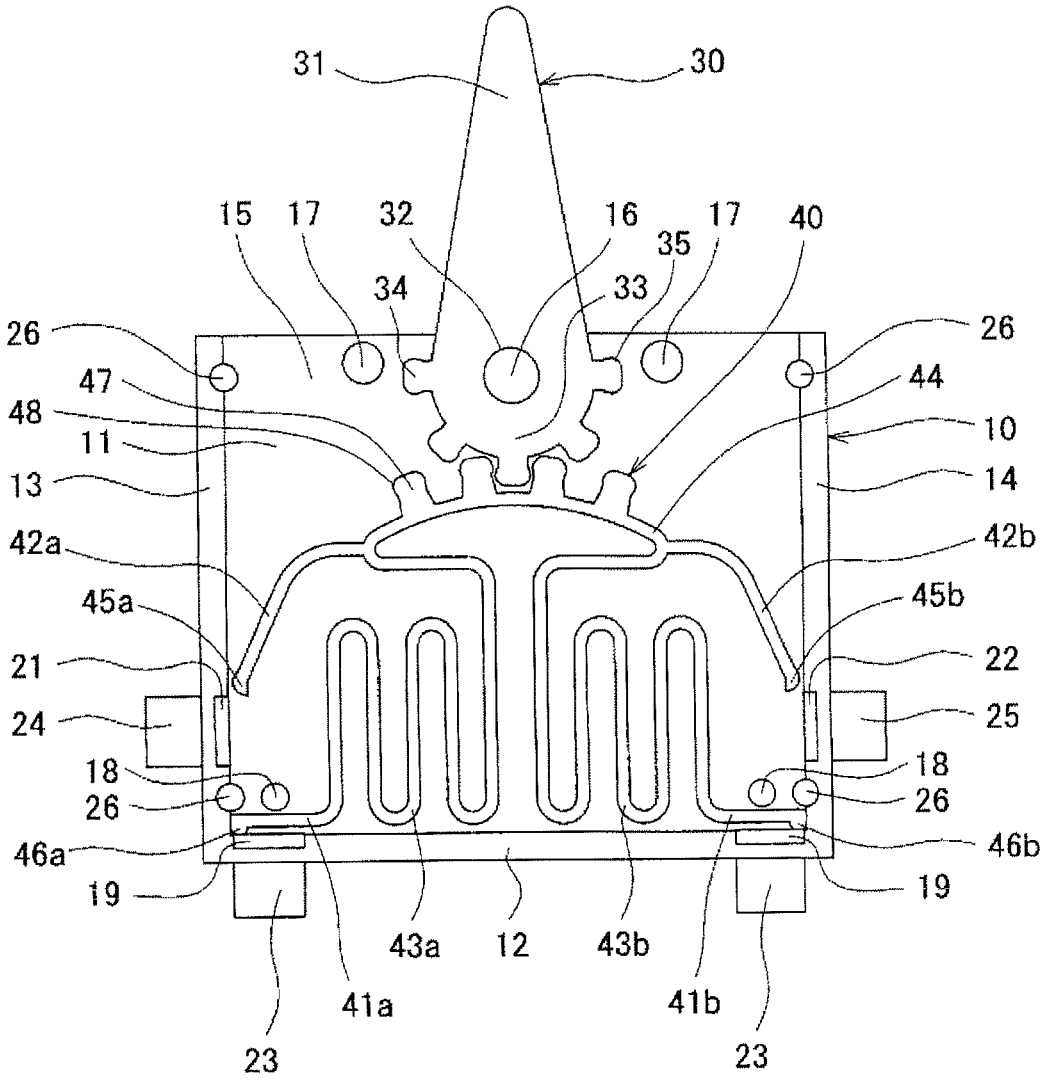
FIG. 7 is a plan view illustrating a state with a cover of the switch of the second embodiment removed.
Figure 8:
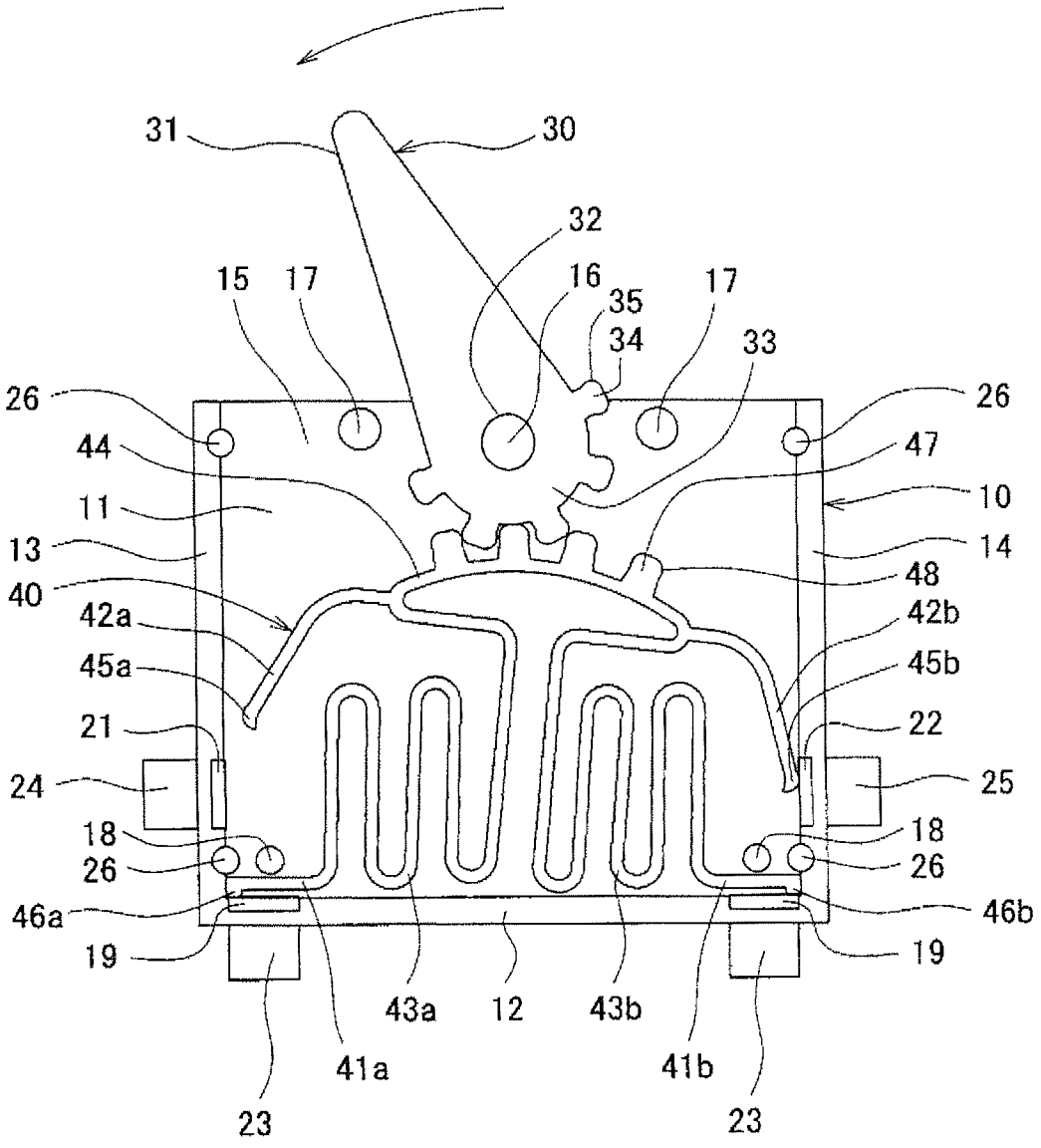
FIG. 8 is a diagram illustrating a switched position of the switch of the second embodiment.

FIG. 6 to FIG. 8 illustrate the switch of a second embodiment of the present invention. In the second embodiment, the same components as those of the first embodiment will be referred to as the same reference numerals, and the description thereof will be omitted.

The driving portion 33 of the actuating arm 30 is formed in nearly a semicircular shape, and teeth 34 are arranged on its periphery at regular intervals. The teeth 34 and corresponding teeth 47 of the electrically conductive elastic member 40 described below may be shaped in an involute curve of a gear or be configured to have protrusions 35, 48 at their tips, respectively, for preventing disengagement as illustrated in FIG. 6 to FIG. 8.

When the actuating arm 30 is rotated by means of the actuating portion 31, the teeth 34 of the driving portion 33 engage with the teeth 47 of the driven part 44 of the electrically conductive elastic member 40 described below, thereby rotatingly driving the electrically conductive elastic member 40 around its lower-end center.

As illustrated in FIG. 7, the electrically conductive elastic member 40 is manufactured by electroforming, including the fixed contacting parts 41*a*, 41*b* and the movable contacting members 42*a*, 42*b*, which are formed symmetrically.

The fixed contacting parts 41*a*, 41*b* extend substantially in parallel with the lower periphery 12 of the base 10 and is positioned by the positioning parts 18 of the base 10.

The movable contacting members 42*a*, 42*b* include the stretching parts 43*a*, 43*b* and the driven part 44.

The stretching parts 43*a*, 43*b* are formed as the bellows-shaped stretching parts in an extendable and compressible manner in the right and left direction from the tips opposite the contacts 46*a*, 46*b* of the fixed contacting parts 41*a*, 41*b*, respectively, and their respective tips extend upward. The tips of the stretching parts 43*a*, 43*b* are both connected to the driven part 44.

The driven part 44 has a peripheral frame formed in an upward protruded semicylindrical shape. The upper curved part of the peripheral frame has the teeth 47 at regular intervals. The teeth 47 engage with the teeth 34 of the driving portion 33 of the actuating arm 30.

The movable contacting member 42*a* extends leftward from the left part of the driven part 44, and at its tip, further extends leftward, obliquely downward. The movable contacting member 42*b* extends rightward from the right part of the driven part 44, and at its tip, further extends rightward, obliquely downward.

The fixed contacting parts 41*a*, 41*b* of the electrically conductive elastic member 40 are arranged and positioned between the lower periphery 12 and the positioning parts 18, 18 of the base 10, thereby housing the electrically conductive elastic member 40 in the recess 11 of the base 10. In addition, the teeth 34 of the actuating arm 30 are adapted to engage with the teeth 47 of the electrically conductive elastic member 40, and the hole 32 of the actuating arm 30 is fitted onto the shaft 16 of the base 10, thereby hosing the actuating arm 30 in the recess 11 of the base 10. After that, the crimping holes 51 of the cover 50 are fitted onto the crimping protrusions 26 of the base 10, and then the crimping protrusions 26 are fused to integrate them.

Next, the operation of the switch having the above structure will be described. For example, the switch according to the second embodiment may be used for a zoom mechanism of a DVD camera.

At the first position (neutral position) illustrated in FIG. 7, the actuating arm 30 extends upward while the teeth 34 the driving portion 33 of the actuating arm 30 and the teeth 47 of the electrically conductive elastic member 40 are engaged with each other. At the first position, the contacts 45*a*, 45*b* are not in contact with any of the fixed contacts 21, 22 and hence the switch serves no electrical connection with the lower fixed contacts 19, 19.

As illustrated in FIG. 8, when the actuating arm 30 is rotated counterclockwise from the first position by means of the actuating portion 31, the teeth 34 of the driving portion 33 of the actuating arm 30 and the teeth 47 of the electrically conductive elastic member 40 engage with each other, thereby rotatingly driving the electrically conductive elastic member 40 clockwise with its lower-end center as the center. This brings the contact 45*b* of the movable contacting member 42*b* into contact with the right fixed contact 22 of the base 10, and the actuating arm 30 reaches the second position. At the second position, the stretching part 43*b* of the electrically conductive elastic member 40 is in a compressed state, causing the right fixed contact 22 and the lower fixed contacts 19, 19 to be electrically connected with each other.

When the load on the actuating arm 30 at the second position is removed, the electrically conductive elastic member 40 elastically returns mainly through the spring force of the stretching part 43*b*, in which the teeth 47 of the electrically conductive elastic member 40 and the teeth 34 of the driving portion 33 of the actuating arm 30 engage with each other, thereby returning the actuating portion 31 to the first position. This disconnects the contact 45*b* from the right fixed contact 22, causing disconnection between the right fixed contact 22 and the lower fixed contacts 19, 19.

When the actuating arm 30 is rotated clockwise from the first position, the actuating arm 30 performs operation opposite to the above.

According to the second embodiment, the teeth 34 of the driving portion 33 of the actuating arm 30 and the teeth 47 of the electrically conductive elastic member 40 are securely engaged with each other, so that the driving force of the driving portion 33 of the actuating arm are transmitted to the driven part 44 of the electrically conductive elastic member 40.

Third Embodiment

Figure 9A:
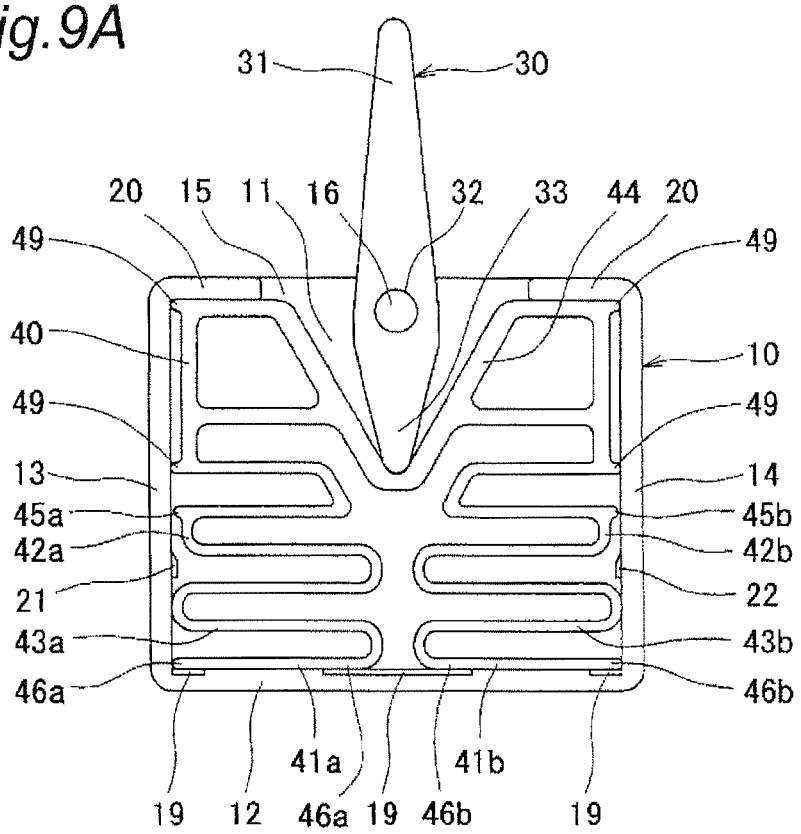
FIGS. 9A and 9B are diagrams illustrating a switch of a third embodiment.

As illustrated in FIG. 9A, the switch according to the third embodiment includes the base 10, the actuating arm 30, and the electrically conductive elastic member 40. For the convenience of description, the cover 50 is omitted.

As illustrated in FIG. 9A, the base 10 forms a U-shaped periphery on the upper face thereof and forms a housing recess (hereinafter, referred to as a recess) 11 that houses the electrically conductive elastic member 40 thereinside. The periphery includes the lower periphery 12, the left periphery 13, the right periphery 14, and an upper periphery 20, and the opening 15 is positioned at the center of the upper periphery 20.

The electrically conductive elastic member 40 is manufactured by electroforming, including the fixed contacting parts 41*a*, 41*b* and the movable contacting members 42*a*, 42*b*, which are formed symmetrically.

The fixed contacting parts 41*a*, 41*b* extend substantially in parallel with the lower periphery 12 of the base 10. Both ends of the fixed contacting parts 41*a*, 41*b* constitute the contacts 46*a*, 46*b*, respectively.

The movable contacting members 42*a*, 42*b* include the stretching parts 43*a*, 43*b* and the driven part 44.

The stretching parts 43*a*, 43*b* are formed in a bellows shape which can be extendable and compressible in the up and down direction so as to extend from the center-side ends of the fixed contacting parts 41*a*, 41*b*, respectively, and their respective tips extend upward near the peripheries 13, 14.

A V-shaped part is arranged on the upper center of the driven part 44, for allowing the driving portion 33 of the actuating arm 30 to be in sliding contact with the V-shaped part. The upper ends of the V-shaped part extend laterally, and the tips extend downward to form a nearly M-shaped part. The tips of the nearly M-shaped part and each of the tips of the stretching parts 43*a*, 43*b* are connected through respective nearly U-shaped parts of which openings are arranged facing the peripheries 13, 14, respectively.

Provided adjacent the peripheries 13, 14 and between the lower ends of the nearly M-shaped part of the driven part 44 and the stretching parts 43*a*, 43*b* are contacts 45*a*, 45*b*, which come into contact with the fixed contacts 21, 22, respectively.

Sliding protrusions 49 that protrude toward the peripheries 13, 14 are formed on the upward/downward and right/left corners of the nearly M-shaped part of the driven part 44. The driven part 44 is in pressure contact with the driving portion 33 of the actuating arm 30.

At the first position (neutral position) illustrated in FIG. 9A, the driving portion 33 of the actuating arm 30 is in contact with the driven part 44 through the V-shaped bottom part. At the first position, the contacts 45*a*, 45*b* are not in contact with any of the fixed contacts 21, 22, and hence the switch is in an off state.

Figure 9B:
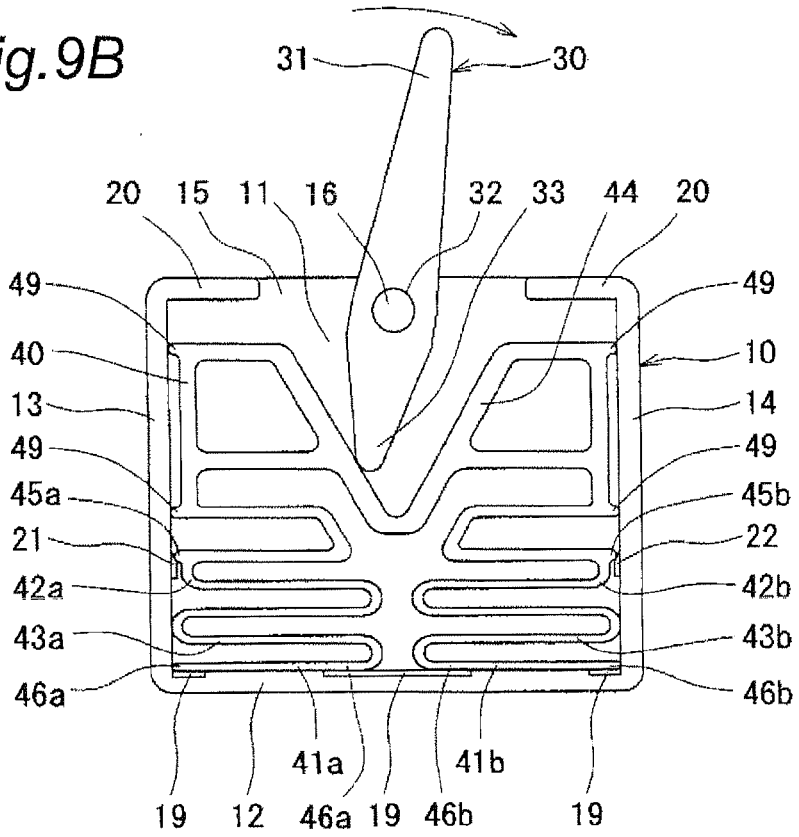

When the actuating arm 30 is rotated clockwise from the first position by means of the actuating portion 31, as illustrated in FIG. 9B, the driving portion 33 of the actuating arm 30 upward slides on the left slope of the V-shaped driven part 44. This presses the electrically conductive elastic member 40 downward and compresses the stretching parts 43*a*, 43*b*. This moves the movable contacting members 42*a*, 42*b* of the electrically conductive elastic member 40 downward and brings the contacts 45*a*, 45*b* of the movable contacting members 42*a*, 42*b* into contact with the fixed contacts 21, 22, and the actuating arm 30 reaches the second position. At the second position, the stretching parts 43*a*, 43*b* are biased toward the first position, and the fixed contacts 21, 22 and the lower fixed contacts 19, 19 are electrically connected with each other.

When the load on the actuating arm 30 positioned at the second position is removed, the electrically conductive elastic member 40 elastically returns through the spring force of the stretching part 43*a*, thereby pushing the actuating arm 30 back to the first position. This disconnects the contacts 45*a*, 45*b* from the fixed contacts 21, 22, which in turn, disconnects the fixed contacts 21, 22 from the lower fixed contacts 19, 19.

When the actuating arm 30 is rotated counterclockwise from the first position, the switch performs the operation similar to that when the actuating arm 30 is rotated clockwise from the first position.

The third embodiment achieves a switch that automatically returns to the first position, when the load on the actuating portion 31 of the actuating arm 30 positioned at the second position that is different from the first position is removed.

Fourth Embodiment

Figure 10A:
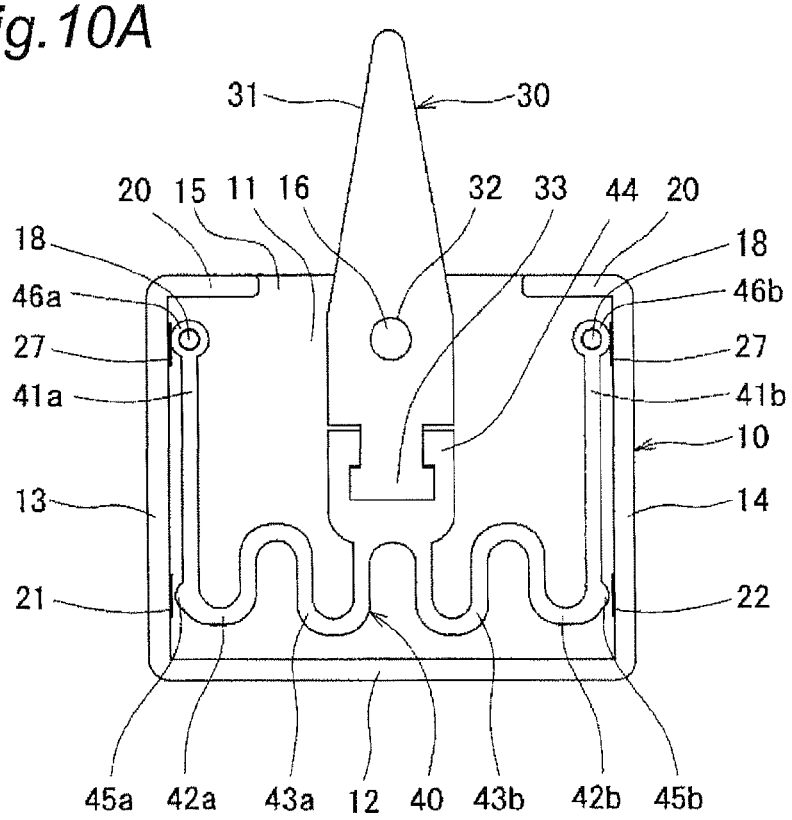
FIGS. 10A and 10B are diagrams illustrating a switch of a fourth embodiment.
Figure 10B:
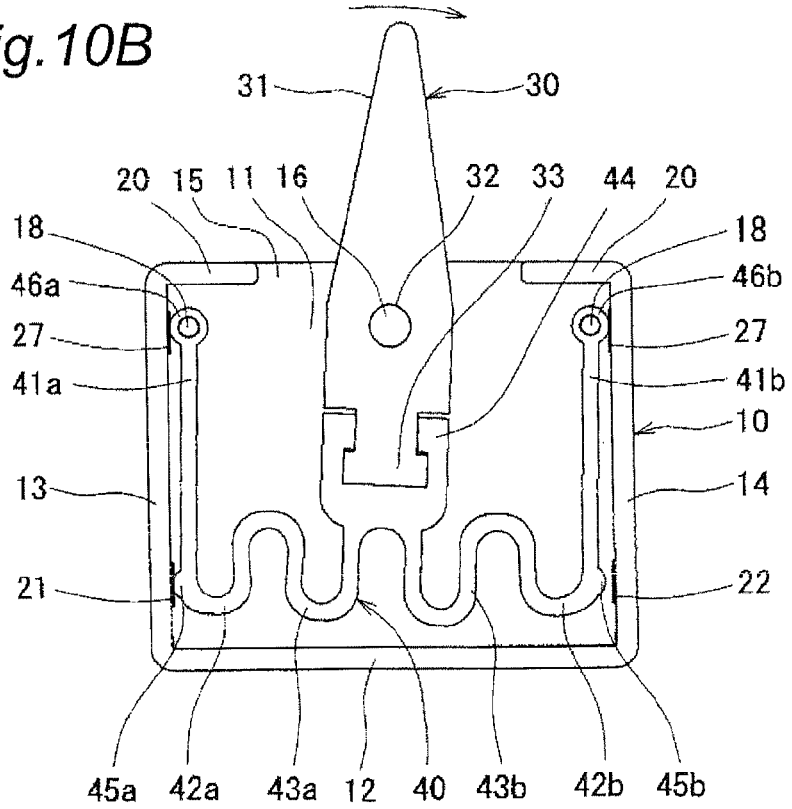

As illustrated in FIGS. 10A and 10B, the switch according to the fourth embodiment includes the base 10, the actuating arm 30, and the electrically conductive elastic member 40. For the convenience of description, the cover 50 is omitted.

As illustrated in FIG. 10A, the base 10 forms a U-shaped periphery on the upper face thereof and forms a housing recess (hereinafter, referred to as a recess) 11 that houses the electrically conductive elastic member 40 thereinside. The periphery includes the lower periphery 12, the left periphery 13, the right periphery 14, and the upper periphery 20, and the opening 15 is positioned at the center of the upper periphery 20.

The driving portion 33 formed on one end of the actuating arm 30 is formed in a protruded shape, allowing engagement with the driven part 44 of the electrically conductive elastic member 40.

The electrically conductive elastic member 40 is manufactured by electroforming, including the movable contacting members 42*a*, 42*b* and the fixed contacting parts 41*a*, 41*b*, which are formed symmetrically. The movable contacting members 42*a*, 42*b* include the stretching parts 43*a*, 43*b* and the driven part 44 formed in a recess configuration that allow engagement with the driving portion 33 of the actuating arm 30.

The electrically conductive elastic member 40 includes the stretching parts 43*a*, 43*b* flexibly extending in the right and left direction from the lower end of the driving portion 33, which have contacts 45*a*, 45*b* that protrude from the tips thereof, respectively. The elastic member 40 also includes fixed contacting parts 41*a*, 41*b*, extending upward from the stretching parts 43*a*, 43*b*, respectively. The contacts 45*a*, 45*b* are formed so as not to come into contact with the fixed contacts 21, 22 of the base 10 when the actuating arm 30 is positioned at the first position.

The fixed contacting parts 41*a*, 41*b* form ring-shaped contacts 46*a*, 46*b* on their ends and are pivotably fitted onto the positioning parts 18 of the base 10. The fixed contacting parts 41*a*, 41*b* are in contact with fixed contacts (second fixed electrode) 27 of the base 10.

The ring-shaped contacts 46*a*, 46*b* of the electrically conductive elastic member 40 are fitted onto the positioning parts 18, 18, respectively, thereby housing the electrically conductive elastic member 40 in the recess 11 of the base 10. In addition, the driving portion 33 of the actuating arm 30 is caused to engage with the driven part 44 of the electrically conductive elastic member 40, and the hole 32 of the actuating arm 30 is fitted onto the shaft 16 of the base 10. After that, the crimping holes 51 of the cover 50 are fitted onto the crimping protrusions 26 of the base 10, and then the crimping protrusions 26 are fused to integrate them.

At the first position illustrated in FIG. 10A, the contacts 45*a*, 45*b* are not in contact with any of the fixed contacts 21, 22, and hence the switch is in an off state.

As illustrated in FIG. 10B, when the actuating arm 30 is rotated clockwise from the first position by means of the actuating portion 31, the driven part 44 also rotates clockwise around the shaft 16 of the base 10. This compresses the stretching part 43*a* and brings the contact 45*a* into contact with the left fixed contact 21, and the actuating arm 30 reaches the second position. At the second position, the stretching part 43*a* is biased toward the first position, and the left fixed contact 21 and the fixed contacts 27, 27 are electrically connected each other.

When the load on the actuating arm 30 positioned at the second position is removed, the stretching part 43*a* elastically returns to the first position. This disconnects the contact 45*a* from the fixed contact 21, which in turn, disconnects the left fixed contact 21 and the fixed contacts 27.

When the actuating arm 30 is rotated counterclockwise from the first position, the switch performs the operation similar to that when the actuating arm 30 is rotated clockwise from the first position.

The fourth embodiment achieves a switch that automatically returns to the first position, when the load on the actuating portion 31 of the actuating arm 30 is removed at the second position away from the first position and also at the third position opposite the second position away from the first position.

Fifth Embodiment

Figure 11A:
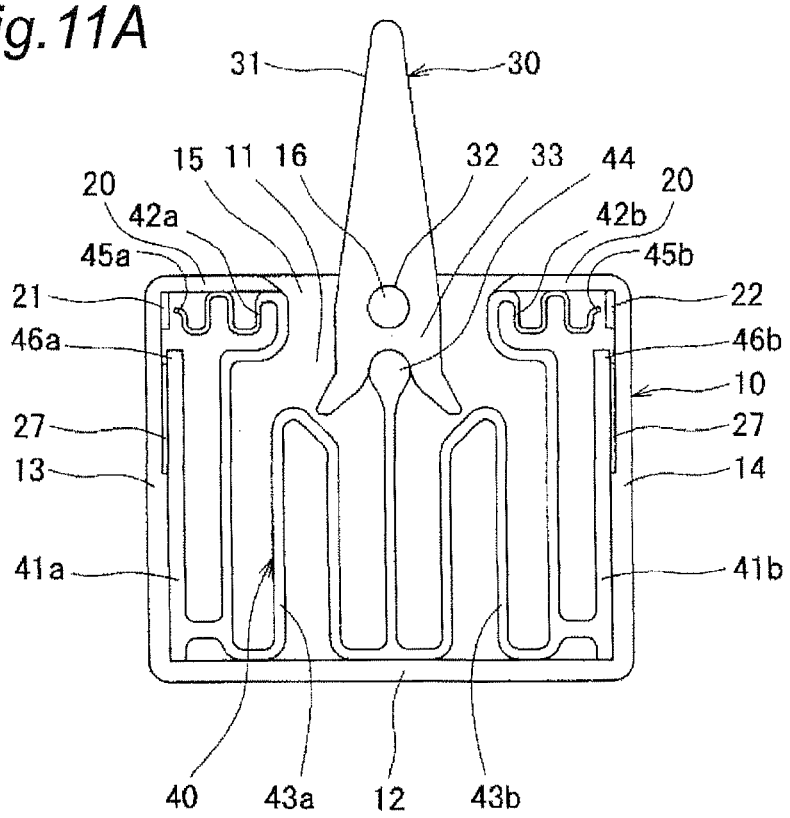
FIGS. 11A and 11B are diagrams illustrating a switch of a fifth embodiment.
Figure 11B:
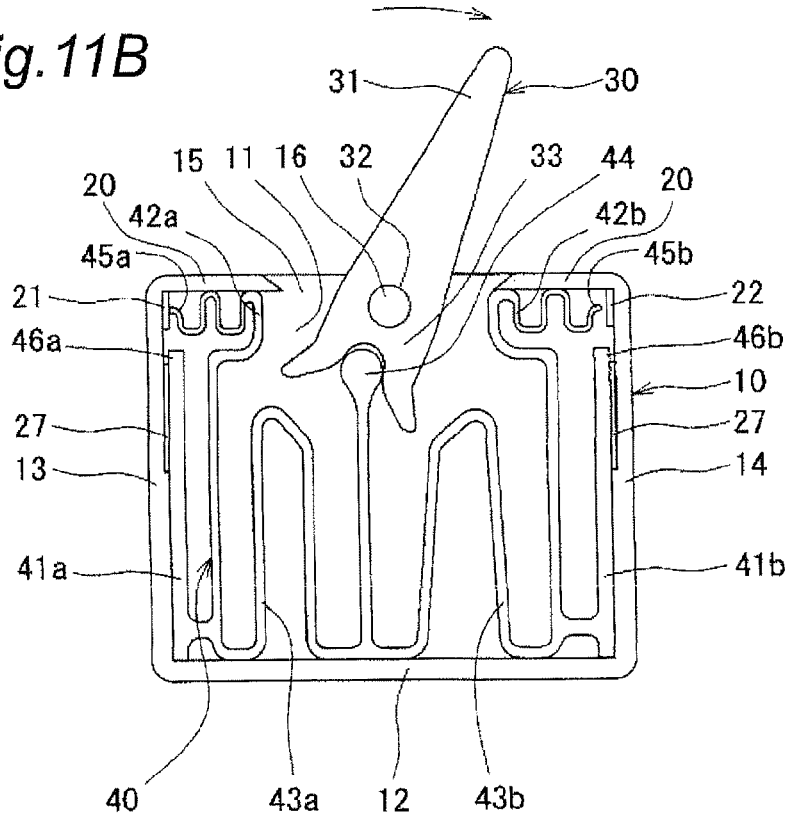

As illustrated in FIGS. 11A and 11B, the switch according to the fifth embodiment includes the base 10, the actuating arm 30, and the electrically conductive elastic member 40. For the convenience of description, the cover 50 is omitted.

As illustrated in FIG. 11A, the base 10 forms a U-shaped periphery on the upper face thereof and forms a housing recess (hereinafter, referred to as a recess) 11 that houses the electrically conductive elastic member 40 thereinside. The periphery includes the lower periphery 12, the left periphery 13, the right periphery 14, and the upper periphery 20, and the opening 15 is positioned at the center of the upper periphery 20.

The driving portion 33 of the actuating arm 30 is formed in a forked shape so as to allow engagement with the driven part 44 of the electrically conductive elastic member 40.

The electrically conductive elastic member 40 includes the driven part 44 that is arranged at the center and extends upward, and the bellows-shaped stretching parts 43*a*, 43*b* extending from the driven part 44 in a symmetric manner. Each of the stretching parts 43*a*, 43*b* branches into part extending toward the peripheries 13, 14 and part extending upward along the peripheries 13, 14, respectively. A nearly circular tip of the driven part 44 can engage with the driving portion 33 of the actuating arm 30.

The movable contacting members 42*a*, 42*b* are connected to the respective tips of the parts extending upward along the peripheries 13, 14 of the stretching parts 43*a*, 43*b*, and at their respective tips, the contacts 45*a*, 45*b* are formed. The contacts 45*a*, 45*b* are formed so as not to come into contact with the fixed contacts 21, 22 of the base 10 when the actuating arm 30 is positioned at the first position.

The fixed contacting parts 41*a*, 41*b* extend upward from the respective tips of the parts extending toward the peripheries 13, 14 of the stretching parts 43*a*, 43*b* so as to be in contact with the left periphery 13 and the right periphery 14 of the base 10.

The electrically conductive elastic member 40 is housed in the recess 11 of the base 10 by compressing the stretching parts 43*a*, 43*b* so as to narrow the spacing between the contacting parts 41*a*, 41*b*. In addition, the driving portion 33 of the actuating arm 30 is caused to engage with the driven part 44 of the electrically conductive elastic member 40, and the hole 32 of the actuating arm 30 is fitted onto the shaft 16 of the base 10. After that, the crimping holes 51 of the cover 50 are fitted onto the crimping protrusions 26 of the base 10, and then the crimping protrusions 26 are fused to integrate them.

At the first position (neutral position) illustrated in FIG. 11A, the contacts 45*a*, 45*b* are not in contact with any of the fixed contacts 21, 22, and hence the switch is in an off state.

As illustrated in FIG. 11B, when the actuating arm 30 is rotated clockwise from the first position by means of the actuating portion 31, the driven part 44 is pressed leftward. This moves the driven part 44 leftward, compresses the stretching part 43*a* in the right and left direction, and extends the stretching part 43*b* in the right and left direction. This also compresses the parts extending toward the peripheries 13, 14 and moves the movable contacting member 42*a* leftward. The contact 45*a* comes into contact with the left fixed contact 21, and the actuating arm 30 reaches the second position. At the second position, the stretching part 43*a* is biased toward the first position, and the left fixed contact 21 and the fixed contacts 27 are electrically connected with each other.

When the load on the actuating arm 30 positioned at the second position is removed, the stretching part 43*a* elastically returns to the first position. This disconnects the contact 45*a* from the left fixed contact 21, which in turn, disconnects the left fixed contact 21 from the fixed contacts 27.

When the actuating arm 30 is rotated counterclockwise from the first position, the switch performs the operation similar to that when the actuating arm 30 is rotated clockwise from the first position.

The fifth embodiment achieves a switch that automatically returns to the first position, when the load on the actuating portion 31 of the actuating arm 30 is removed at the second position away from the first position and also at the third position opposite the second position away from the first position.

Alternatively, as described above with reference to FIG. 5, the switch of the first embodiment may be structured to automatically return to the first position when the load on the actuating portion 31 of the actuating arm 30 at the second position on one side of the first position is removed, but to keep stationary at the third position on the other side thereof.

Figure 12:
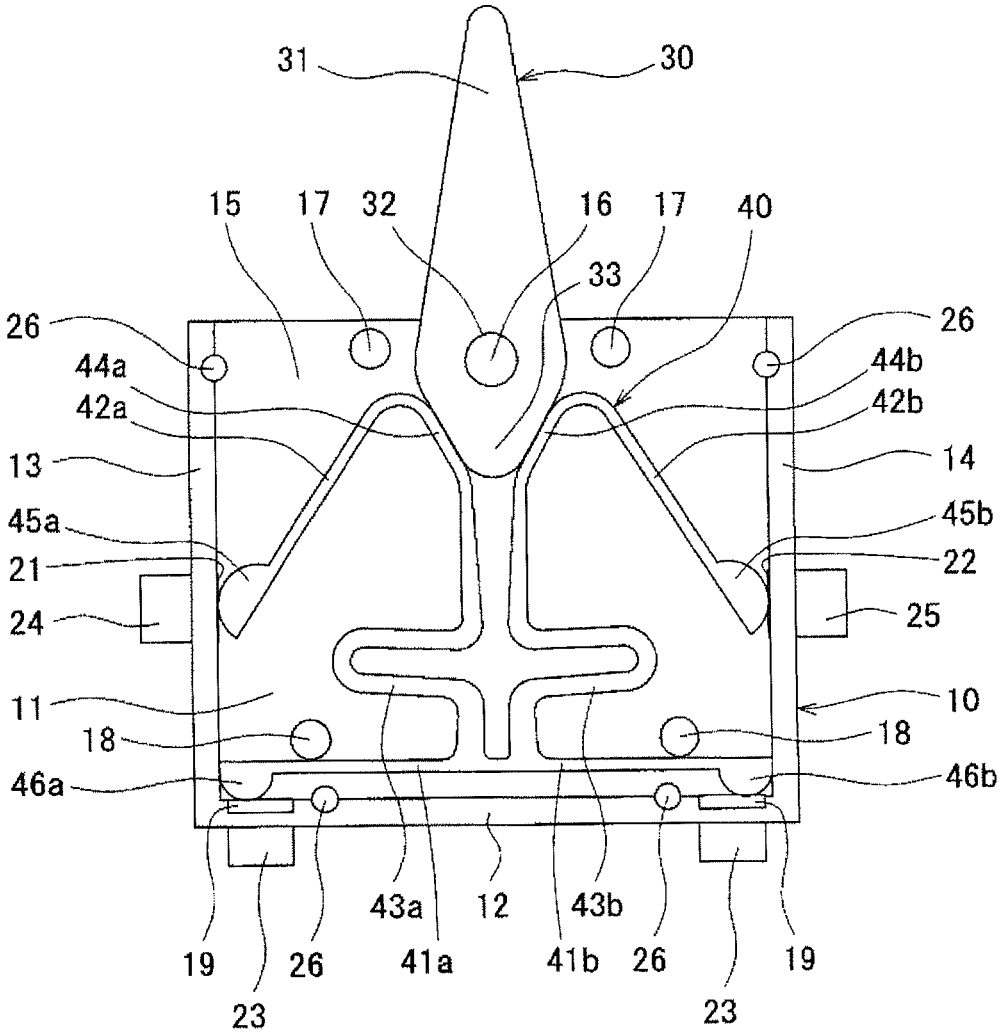
FIG. 12 is a diagram illustrating a modification of the switch of the first embodiment.

Furthermore, as illustrated in FIG. 12, a switch may be constituted so that at the first position, the contacts 45*a*, 45*b* of the electrically conductive elastic member 40 are in contact with the first fixed electrodes 21, 22, and at the second position, the contact 45*a* of the electrically conductive elastic member 40 is disconnected from the first fixed electrode 21 with the stretching part 43*a* of the electrically conductive elastic member 40 compressed, or the contact 45*b* of the electrically conductive elastic member 40 is disconnected from the first fixed electrode 22 with the stretching part 43*b* of the electrically conductive elastic member 40 compressed. This enables the switch to be a normally-on state at the first position (neutral position) and enables the switch to be an off state at the second position.

Although the above describes the switch having the switched positions on both sides of the first position, a switch may be constituted that can be switched only to one side of the first position.

It is understood that the switch according to the present invention is not limited to the above shapes and may be a switch constituted by combining an actuating arm and an electrically conductive elastic member having other shapes.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

10 Base
11 Housing recess
12 Lower periphery
13 Left periphery
14 Right periphery
15 Opening
16 Shaft (Support)
17 Restricting part
18 Positioning part
19 Lower fixed contact (Second fixed electrode)
20 Upper periphery
21 Left fixed contact (First fixed electrode)
22 Right fixed contact (First fixed electrode)
23, 24, 25 Connecting part
26 Crimping protrusion
27 Fixed contact (Second fixed electrode)
30 Actuating arm
31 Actuating portion
32 Hole (Inserted part)
33 Driving portion
34 Teeth
40 Electrically conductive elastic member
41*a*, 41*b* Fixed contacting part
42*a*, 42*b* Movable contacting member
43*a*, 43*b* Stretching part
44, 44*a*, 44*b* Driven part
45*a*, 45*b* Contact (Movable contact)
46*a*, 46*b* Contact (Fixed contact)
47 Teeth
48 Tip
49 Sliding protrusion
50 Cover
51 Crimping hole
60 Engagement recess

The invention claimed is:

1. A switch, comprising:

an actuating arm including an actuating portion and a driving portion;

a base including a support that supports the actuating arm, and a recess having a first fixed electrode and a second fixed electrode arranged on the inner side face; and an electrically conductive elastic member that is housed within the recess of the base, wherein the electrically conductive elastic member includes at least one driven part that is driven by the driving portion of the driving body and at least one bellows-shaped stretching part that is extendable and compressible through input to the at least one driven part, at least one movable contacting member having a movable contact capable of being connected to the first fixed electrode, and at least one fixed contacting part having a fixed contact capable of being connected to the second fixed electrode, wherein the switch has a first position in which the movable contact is disconnected from the first fixed electrode, and a second position in which the at least one bellows-shaped stretching part of the electrically conductive elastic member is in a compressed state and the movable contact is in contact with the first fixed electrode, wherein the actuating arm is capable of being moved from the first position to the second position when a load is applied to the actuating arm at the first position, and wherein the actuating arm is automatically returned from the second position to the first position when the load on the actuating arm is removed at the second position.

2. The switch according to claim 1, wherein the electrically conductive elastic member is manufactured by electroforming, and wherein the at least one fixed contacting part, the at least bellows-shaped one stretching part, the at least one driven part, and the at least one movable contacting member are arranged on the same plane.

3. The switch according to claim 1, wherein the upper faces of the actuating arm and the electrically conductive elastic member are flush with the upper face of the base.

4. The switch according to claim 1, further comprising a third position, on the opposite side of the second position with respect to the first position, that is a compressed state from which the at least one bellows-shaped stretching part of the electrically conductive elastic member automatically returns the actuating arm to the first position and in which the movable contact is in contact with the first fixed electrode.

5. The switch according to claim 1, further comprising a third position, on the opposite side of the second position with respect to the first position, that is a compressed state from which the at least one bellows-shaped stretching part of the electrically conductive elastic member automatically returns the actuating arm to the first position and in which the movable contact is disconnected from the first fixed electrode.

6. The switch according to claim 1, wherein the electrically conductive elastic member is integrally formed.

7. A switch, comprising:

an actuating arm including an actuating portion and a driving portion;

a base including a support that supports the actuating arm, and a recess having a first fixed electrode and a second fixed electrode arranged on the inner side face; and an electrically conductive elastic member that is housed within the recess of the base, wherein the electrically conductive elastic member includes at least one driven part that is driven by the driving portion of the driving body and at least one stretching part that is extendable and compressible through input to the at least one driven part, at least one movable contacting member having a movable contact capable of being connected to the first fixed electrode, and at least one fixed contacting part having a fixed contact capable of being connected to the second fixed electrode, wherein the switch has a first position in which the movable contact is disconnected from the first fixed electrode, and a second position in which the at least one stretching part of the electrically conductive elastic member is in a compressed state and the movable contact is in contact with the first fixed electrode, wherein the actuating arm is capable of being moved from the first position to the second position when a load is applied to the actuating arm at the first position, wherein the actuating is automatically returned from the second position to the first position when the load on the actuating arm is removed at the second position, and wherein the driving portion of the actuating arm and the at least one driven part of the electrically conductive elastic member are gear mechanisms.

8. A switch, comprising:

an actuating arm including an actuating portion and a driving portion;

a base including a support that supports the actuating arm, and a recess having a first fixed electrode and a second fixed electrode arranged on the inner side face; and an electrically conductive elastic member that is housed within the recess of the base, wherein the electrically conductive elastic member includes at least one driven part that is driven by the driving portion of the driving body and at least one bellows-shaped stretching part that is extendable and compressible through input to the at least one driven part, at least one movable contacting member having a movable contact capable of being connected to the first fixed electrode, and at least one fixed contacting part having a fixed contact capable of being connected to the second fixed electrode, wherein the switch has a first position in which the movable contact is in contact with the first fixed electrode and a second position in which the at least one bellows-shaped stretching part of the electrically conductive elastic member is in a compressed state, and the movable contact is disconnected from the first fixed electrode, wherein the actuating arm is capable of being moved from the first position to the second position when a load is applied to the actuating arm at the first position, and wherein the actuating arm is automatically returned from the second position to the first position when the load on the actuating arm is removed at the second position.

9. The switch according to claim 8, wherein the electrically conductive elastic member is manufactured by electroforming, and wherein the at least one fixed contacting part, the at least one bellows-shaped stretching part, the at least one driven part, and the at least one movable contacting member are arranged on the same plane.

10. The switch according to claim 8, wherein the upper faces of the actuating arm and the electrically conductive elastic member are flush with the upper face of the base.

11. The switch according to claim 8, further comprising a third position, on the opposite side of the second position with respect to the first position, that is a compressed state from which the at least one bellows-shaped stretching part of the electrically conductive elastic member automatically returns the actuating arm to the first position and in which the movable contact is in contact with the first fixed electrode.

12. The switch according to claim 8, further comprising a third position, on the opposite side of the second position with respect to the first position, that is a compressed state from which the at least one bellows-shaped stretching part of the electrically conductive elastic member automatically returns the actuating arm to the first position and in which the movable contact is disconnected from the first fixed electrode.

13. The switch according to claim 8, wherein the electrically conductive elastic member is integrally formed.

14. A switch, comprising:

an actuating arm including an actuating portion and a driving portion;

a base including a support that supports the actuating arm, and a recess having a first fixed electrode and a second fixed electrode arranged on the inner side face; and an electrically conductive elastic member that is housed within the recess of the base, wherein the electrically conductive elastic member includes at least one driven part that is driven by the driving portion of the driving body and at least one stretching part that is extendable and compressible through input to the at least one driven part, at least one movable contacting member having a movable contact capable of being connected to the first fixed electrode, and at least one fixed contacting part having a fixed contact capable of being connected to the second fixed electrode, wherein the switch has a first position in which the movable contact is in contact with the first fixed electrode and a second position in which the at least one stretching part of the electrically conductive elastic member is in a compressed state, and the movable contact is disconnected from the first fixed electrode, wherein the actuating arm is capable of being moved from the first position to the second position when a load is applied to the actuating arm at the first position, wherein the actuating arm is automatically returned from the second position to the first position when the load on the actuating arm is removed at the second position, and wherein the driving portion of the actuating arm and the at least one driven part of the electrically conductive elastic member are gear mechanisms.

* * * * *